US010830109B2

(12) United States Patent
Hiramatsu

(10) Patent No.: US 10,830,109 B2
(45) Date of Patent: Nov. 10, 2020

(54) VARIABLE VALVE MECHANISM OF INTERNAL COMBUSTION ENGINE

(71) Applicant: OTICS CORPORATION, Nishio (JP)

(72) Inventor: Naoki Hiramatsu, Nishio (JP)

(73) Assignee: OTICS CORPORATION, Nishio (JP)

( * ) Notice: Subject to any disclaimer, the term of this patent is extended or adjusted under 35 U.S.C. 154(b) by 0 days.

(21) Appl. No.: 16/285,472

(22) Filed: Feb. 26, 2019

(65) Prior Publication Data

US 2019/0284967 A1 Sep. 19, 2019

(30) Foreign Application Priority Data

Mar. 16, 2018 (JP) ..... 2018-048945

(51) Int. Cl.
*F01L 1/34* (2006.01)
*F01L 1/18* (2006.01)
(Continued)

(52) U.S. Cl.
CPC ..... *F01L 1/34* (2013.01); *F01L 1/185* (2013.01); *F01L 1/462* (2013.01);
(Continued)

(58) Field of Classification Search
CPC ..... F01L 1/18; F01L 1/185; F01L 1/46; F01L 1/462; F01L 1/34; F01L 13/0005;
(Continued)

(56) References Cited

U.S. PATENT DOCUMENTS

2003/0111031 A1* 6/2003 Hendricksma ..... F01L 13/0036 123/90.15
2012/0138002 A1* 6/2012 Tsuzuki ..... F01L 1/185 123/90.18
(Continued)

FOREIGN PATENT DOCUMENTS

DE 10 2013 210 988 A1 12/2014
JP 2004-143933 A 5/2004
(Continued)

OTHER PUBLICATIONS

Extended European Search Report dated Jul. 31, 2019 for European Patent Application No. 19158199.0-1007.

*Primary Examiner* — Devon C Kramer
*Assistant Examiner* — Kelsey L Stanek
(74) *Attorney, Agent, or Firm* — McGinn I.P. Law Group, PLLC

(57) ABSTRACT

A variable valve mechanism includes a first member and a second member which are disposed between a cam and a valve, a switch pin that is displaced to connect and disconnect the first member to and from the second member, and a displacement device. The displacement device includes a ring-shaped plate that is fitted on a camshaft of the cam so as to be co-rotatable with the camshaft and slidable in a longitudinal direction of the camshaft and that has one side surface configured to contact the switch pin and has the other side surface including a tapered surface formed so that a plate thickness increases toward a rotational direction, and a support device formed by a support pin and a moving device
(Continued)

that moves the support pin to a position where the support pin contacts the tapered surface and a position not contacting the tapered surface.

14 Claims, 10 Drawing Sheets

(51) Int. Cl.
*F01L 1/46* (2006.01)
*F01L 13/00* (2006.01)

(52) U.S. Cl.
CPC ..... *F01L 13/0005* (2013.01); *F01L 13/0036* (2013.01); *F01L 2001/186* (2013.01); *F01L 2013/0052* (2013.01); *F01L 2305/02* (2020.05)

(58) Field of Classification Search
CPC ..... F01L 13/0036; F01L 2001/467; F01L 2001/186; F01L 2013/0052; F01L 2105/02; F01L 2105/00; Y10T 74/2107; Y10T 74/20882
USPC ..... 123/90.17, 90.15, 90.16, 90.39, 90.44
See application file for complete search history.

(56) References Cited

U.S. PATENT DOCUMENTS

| | | | | |
|---|---|---|---|---|
| 2014/0083380 | A1* | 3/2014 | Hiramatsu ..... | F01L 1/185 123/90.15 |
| 2017/0122143 | A1* | 5/2017 | Yano ..... | F01L 13/0036 |
| 2018/0163865 | A1 | 6/2018 | Semet et al. | |

FOREIGN PATENT DOCUMENTS

| | | | |
|---|---|---|---|
| JP | 2014-062500 | A | 3/2014 |
| WO | WO 2017/054953 | A1 | 4/2017 |

* cited by examiner

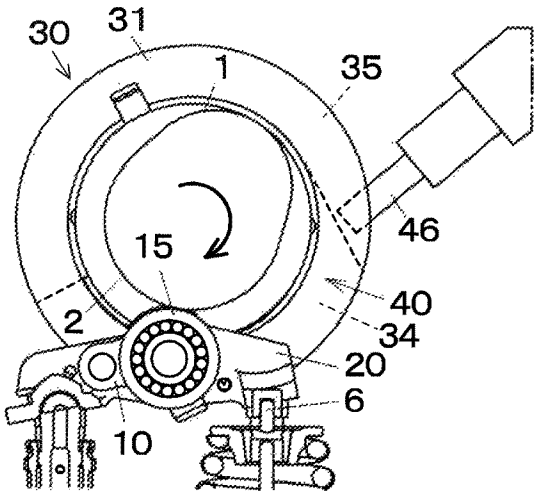
FIG. 8A3
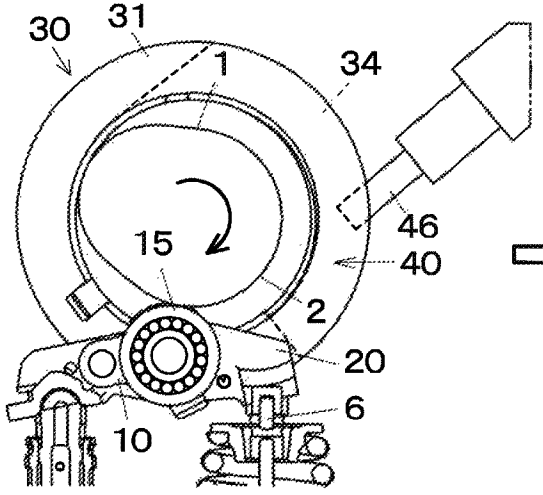
FIG. 8A2
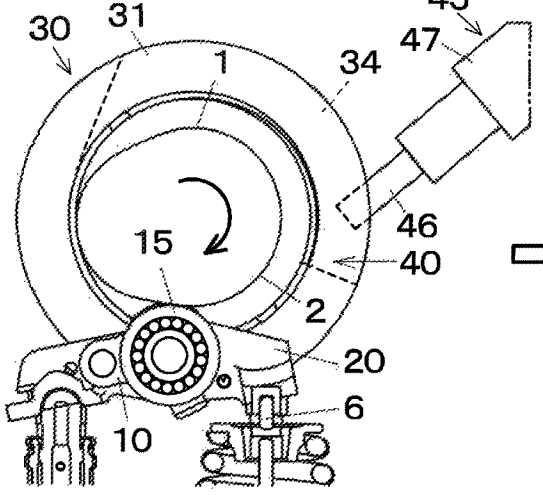
FIG. 8A1
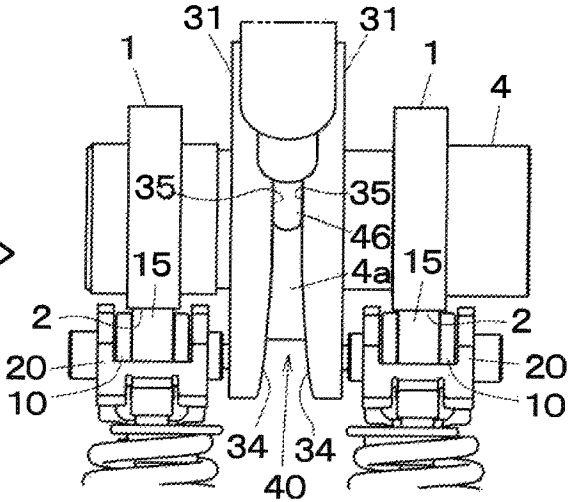
FIG. 8B3
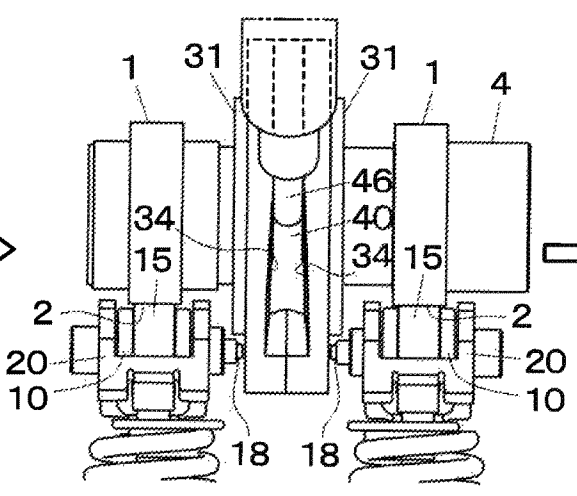
FIG. 8B2
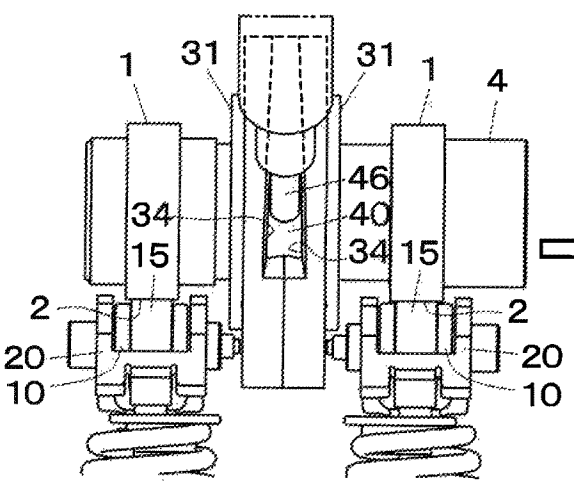
FIG. 8B1

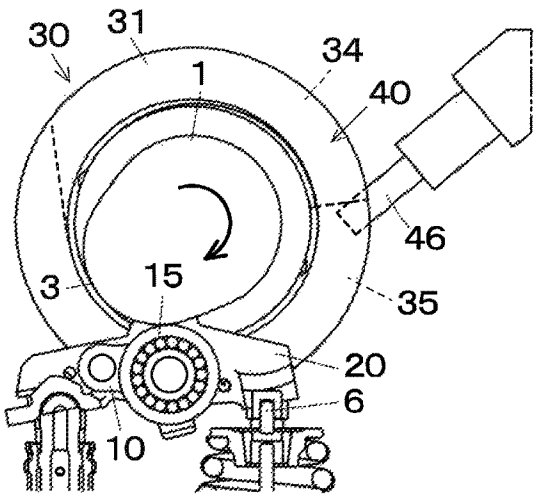
FIG. 9A3
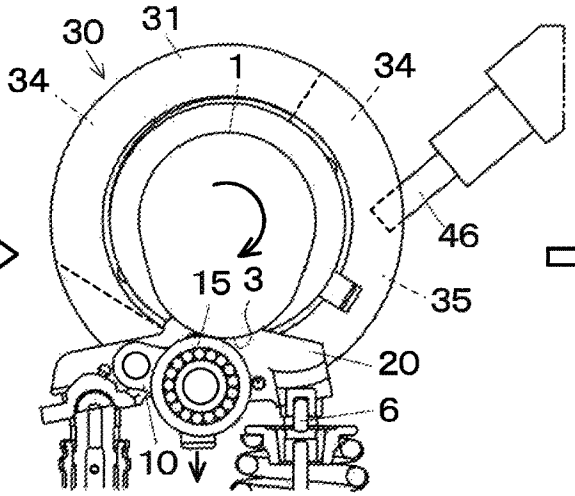
FIG. 9A2
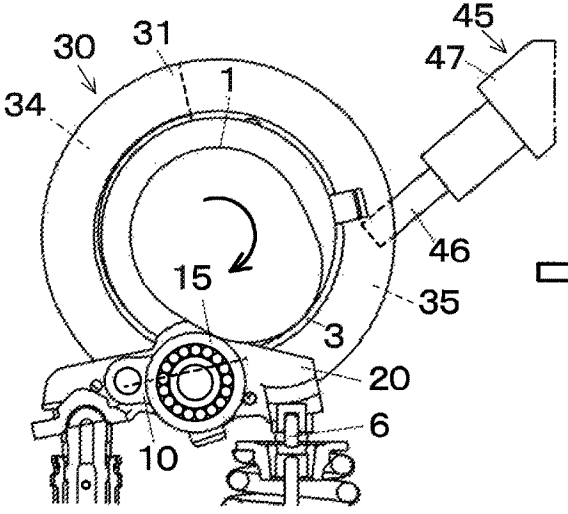
FIG. 9A1
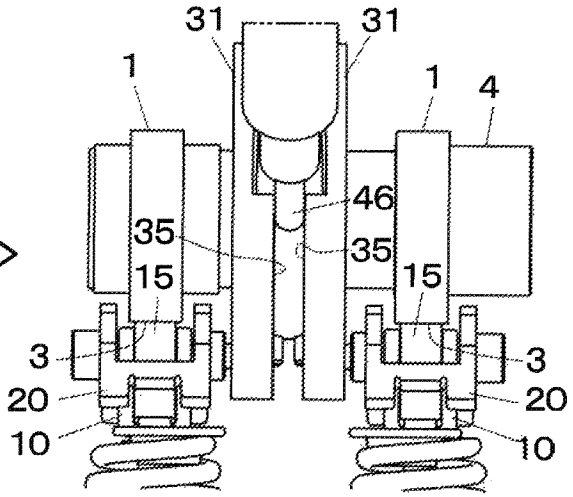
FIG. 9B3
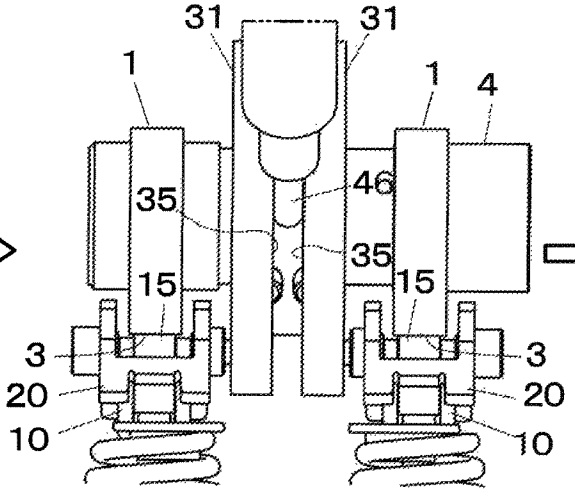
FIG. 9B2
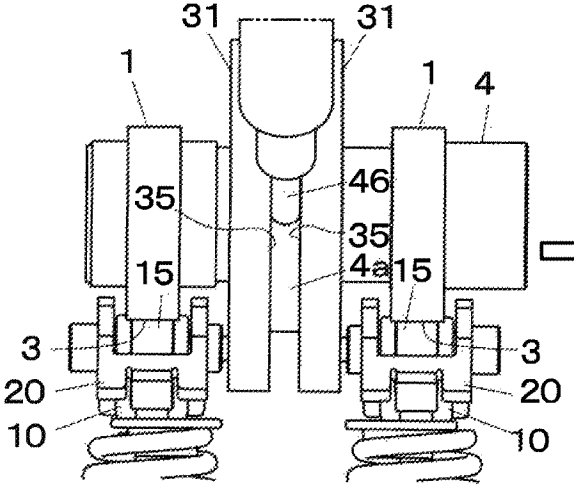
FIG. 9B1

VARIABLE VALVE MECHANISM OF INTERNAL COMBUSTION ENGINE

TECHNICAL FIELD

The present invention relates to variable valve mechanisms of internal combustion engines.

BACKGROUND ART

One example of variable valve mechanisms that change a valve lift of an internal combustion engine or deactivate a valve is a switchable arm that switches the connection state between a first arm and a second arm between a connected state and a disconnected state by a displaceable switch pin. A displacement device that displaces the switch pin is disposed inside the first arm and the second arm in some cases and is disposed outside the first arm and the second arm in other cases. Patent Document 1 is an example in which the switch pin is disposed outside the first arm and the second arm.

CITATION LIST

Patent Documents

[Patent Document 1] Japanese Patent Application Publication No. 2014-62500 (JP 2014-62500 A)

SUMMARY OF INVENTION

Technical Problem

FIG. 10 shows two of the variable valve mechanisms of Patent Document 1 (the mechanisms that switch the connection state between a first arm 51 and a second arm 52 between a connected state and a disconnected state by displacing switch pins 54 to 56 by a displacement device 53 disposed outside the first arm 51 and the second arm 52) which are arranged next to each other. Patent Document 1 describes that the displacement device 53 may be either a hydraulic displacement device or an electromagnetic displacement device. FIG. 10 shows an example of a hydraulic displacement device.

As described above, in order to displace the switch pins 54 to 56 of the two variable valve mechanisms by the displacement device 53 disposed outside the first arm 51 and the second arm 52, space is required between the arms in a cylinder head and the displacement device 53 needs to be disposed in this space. Mountability of the displacement device 53 is therefore a first problem.

In the case where the displacement device 53 is a hydraulic displacement device, the timing of the displacement device 53 may not be controlled as desired, and the switch pins 54 to 56 may rebound between the first arm 51 and the second arm 52. Such rebound of the switch pins 54 to 56 is therefore a second problem.

It is an object of the present invention to provide a variable valve mechanism that implements excellent mountability of a displacement device for a switch pin and reduces rebounding of the switch pin.

Solution to Problem

According to the present invention, a variable valve mechanism of an internal combustion engine includes a first member and a second member which are disposed between a cam and a valve, a switch pin that is displaced to connect and disconnect the first member to and from the second member, and a displacement device that is disposed outside the first member and the second member and displaces the switch pin. The displacement device includes a ring-shaped plate that is fitted on a camshaft of the cam so as to be co-rotatable with the camshaft and slidable in a longitudinal direction of the camshaft, and that has one side surface configured to contact the switch pin and has the other side surface including a tapered surface formed so that a plate thickness increases toward a rotational direction, and a support device formed by a support pin and a moving device that moves the support pin to a position where the support pin contacts the tapered surface and a position where the support pin does not contact the tapered surface.

[Functions]

When the support pin is located at the position where the support pin does not contact the tapered surface of the ring-shaped plate, the ring-shaped plate does not slide in the longitudinal direction of the camshaft even when the ring-shaped plate co-rotates with the camshaft. The ring-shaped plate therefore does not displace the switch pin.

When the support pin is located at the position where the support pin contacts the tapered surface of the ring-shaped plate and the ring-shaped plate co-rotates with the camshaft, the plate thickness at the position where the support pin contacts the tapered surface increases with the rotation. The ring-shaped plate therefore slides in the longitudinal direction of the camshaft and displaces the switch pin.

As described above, the displacement device displaces the switch pin by using the co-rotation of the ring-shaped plate mounted on the camshaft with the camshaft and the sliding of the ring-shaped plate, thereby connecting and disconnecting the first member to and from the second member. Since the ring-shaped plate, which is a main member of the displacement device, is mounted on the camshaft, no space is required between the arms in a cylinder head. The invention can thus solve the first problem described above. Since the ring-shaped plate co-rotates with the camshaft (that is, rotates synchronously with the cam) and the switch pin can be displaced according to the cam timing, rebounding of the switch pin can be reduced. The invention can thus solve the second problem described above.

Advantageous Effects of Invention

According to the present invention, excellent mountability of the displacement device for the switch pin can be implemented and rebounding of the switch pin can be reduced.

BRIEF DESCRIPTION OF DRAWINGS

FIG. 2A is a side view, FIG. 2B is a side section when in a connected state in a nose phase, and FIG. 2C is a side section when in a disconnected state in the nose phase;

FIG. 3A is a horizontal section when in the connected state and FIG. 3B is a horizontal section when in the disconnected state;

FIG. 7A is an exploded perspective view, FIG. 7B is a sectional view in the state where ring-shaped plates contact each other (the connected state), and FIG. 7C is a sectional view in the state where the ring-shaped plates are separated from each other (the disconnected state);

FIGS. 8A1 to 8B3 illustrate abase circle phase at the time of switching the connection state from the connected state to the disconnected state by the variable valve mechanism, where FIGS. 8A1 and 8B1 are a side view and a front view in the beginning part of a base circle phase, FIGS. 8A2 and 8B2 are a side view and a front view in an intermediate part of the base circle phase, and FIGS. 8A3 and 8B3 are a side view and a front view in the latter half of the base circle phase;

FIGS. 9A1 to 9B3 illustrate a nose phase at the time of switching the connection state from the connected state to the disconnected state by the variable valve mechanism, where FIGS. 9A1 and 9B1 are a side view and a front view in the beginning part of the nose circle phase, FIGS. 9A2 and 9B2 are a side view and a front view at the peak of the nose phase, and FIGS. 9A3 and 9B3 are a side view and a front view in the latter half of the nose phase.

DESCRIPTION OF EMBODIMENTS

Figure 1:
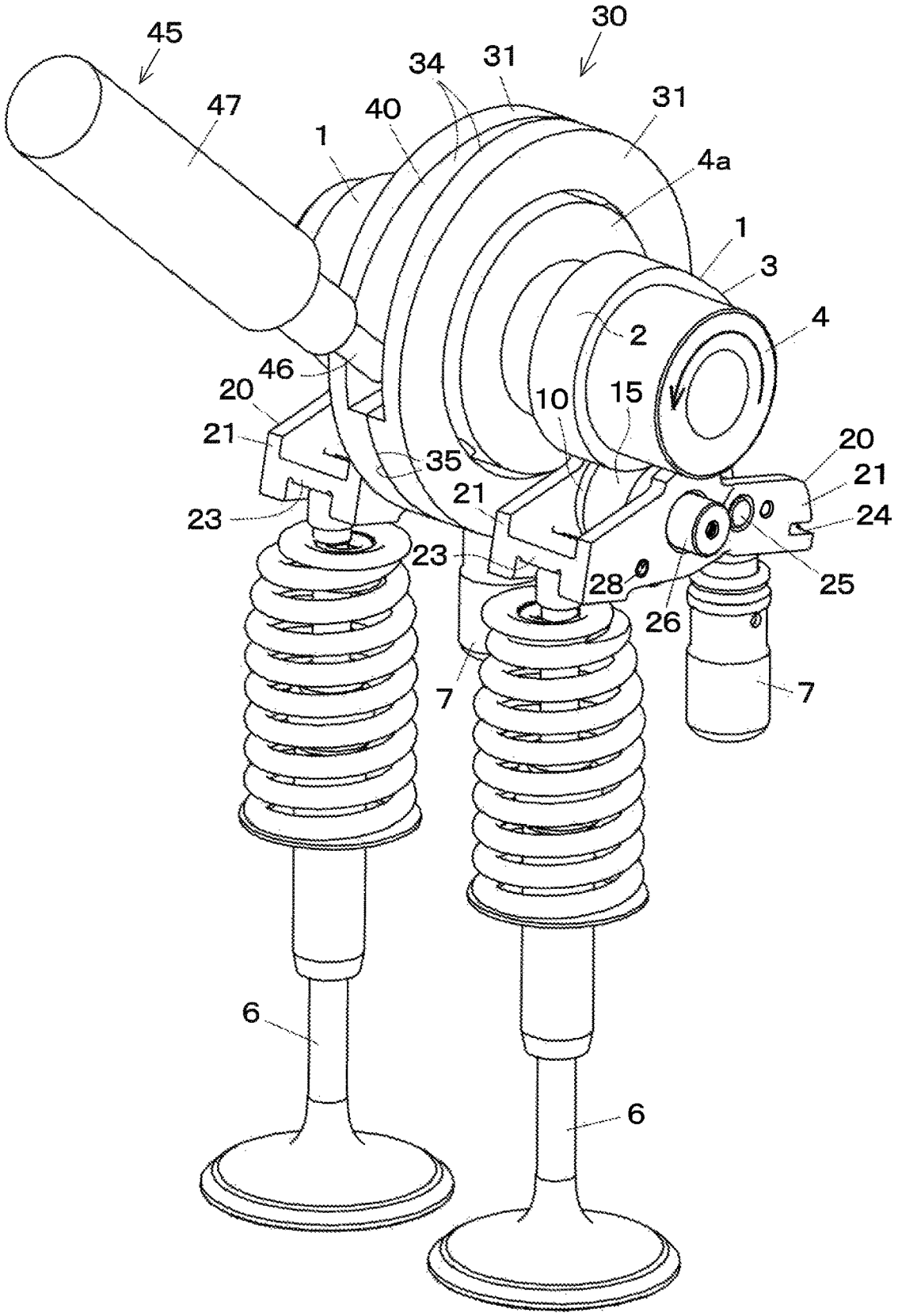
FIG. 1 is a perspective view of a variable valve mechanism of an embodiment.

The displacement device simultaneously displaces the switch pins of two adjacent sets of the input and output arms and includes two of the ring-shaped plates such that the two tapered surfaces thereof face each other. The support pin can be inserted from the outside into a tapered groove formed by the two tapered surfaces so that the support pin is located at the position where the support pin contacts the tapered surfaces, and the support pin can be removed from the tapered groove to the outside so that the support pin is located at the position where the support pin does not contact the tapered surfaces.

A mechanism that makes the ring-shaped plate co-rotatable with the camshaft and slidable in the longitudinal direction of the camshaft is not particularly limited, but may be a key and a keyway. In this case, the key may be placed in the camshaft and the keyway may be formed in the ring-shaped plate. Alternatively, the keyway may be formed in the camshaft and the key may be formed in the ring-shaped plate.

It is preferable that the variable valve mechanism of the internal combustion engine further include a plate biasing mechanism that biases the ring-shaped plate in a direction toward the other side surface of the ring-shaped plate. The plate biasing mechanism is not particularly limited, but may be a mechanism formed by a plate spring placed in a hole extending through the camshaft in a direction orthogonal to the camshaft, balls disposed at both ends of the plate spring, and a tilted surface of a V-shaped groove formed in an inner periphery of the ring-shaped plate so that the balls contact the tilted surface.

The first and second members disposed between the cam and the valve are not limited to specific forms, but may be in the following forms.

The first member may an input member that is displaced when pushed by the cam, and the second member may be an output member that is displaced to push the valve.

In the case where there are the input member that is displaced when pushed by the cam, the output member that is displaced to push the valve, and an interposed member interposed between the input and output members, the first member may be the input member and the second member may be the interposed member, or the first member may be the interposed member and the second member may be the output member.

The output member may be in the form of a swingable arm, a direct acting valve lifter, etc. In the case where the output member is a swingable arm, the input member may also be a swingable arm.

Embodiment

An embodiment of the present invention will be described with reference to FIGS. 1 to 9B3. The structure, shape, number, etc. of parts described below are merely by way of example and may be modified as appropriate without departing from the spirit and scope of the invention.

A variable valve mechanism of the present embodiment includes: an input arm 10 as a first member and an output arm 20 as a second member which are disposed between a cam 1 and a valve 6; switch pins 16 to 18 that are displaced to connect and disconnect the input arm 10 to and from the output arm 20; and a displacement device 30 that is disposed outside the input arm 10 and the output arm 20 and displaces the switch pins 16 to 18. The displacement device 30 is intended to simultaneously displace the switch pins 16 to 18 of two adjacent sets of input and output arms 10, 20. FIGS. 1, 4, 6, and 7A to 7C show the two sets of input and output arms 10, 20 etc. Although the present embodiment is characterized by the displacement device 30, the configurations other than the displacement device 30 will be described first.

The cam 1 is fitted on a camshaft 4 extending in a lateral direction and rotates with the camshaft 4 with rotation of an internal combustion engine. The cam 1 includes a base circle 2 with a circular section and a nose 3 protruding from the base circle 2.

As shown in FIGS. 1 to 3B etc., the output arm 20 that swings to push the valve 6 is an outer arm and includes two side walls 21, a base portion 22, and an acting portion 23. The two side walls 21 extend next to each other at an interval in the lateral direction. The base portion 22 connects the rear end portions of the two side walls 21. The acting portion 23 connects the distal end portions of the two side walls 21. The base portion 22 has a hemispherical recess in its lower surface. A hydraulic lash adjuster 7 mounted in a cylinder head has a hemispherical portion at its upper end. The hemispherical recess is slidably fitted on the hemispherical portion. The output arm 20 is thus supported so as to be swingable about the hemispherical portion. The lower surface of the acting portion 23 serves as a valve pushing surface.

Each of the two side walls 21 has a spring retaining recess 24 in the lower part of its rear end. The spring retaining recesses 24 of the two side walls 21 support the rear portions of lost motion springs 29.

Each of the two side walls 21 further has a support hole formed at a position closer to its front than its base portion so as to extend therethrough. A support pin 25 is placed in the support holes of the two side walls 21.

One of the two side walls 21 has an attachment hole formed at a position closer to its front than the support hole so as to extend therethrough. A first tubular member 26 having an annular bottom is placed in the attachment hole.

The other side wall 21 has an attachment hole formed at a position closer to its front than the support hole so as to extend therethrough. A second tubular member 27 having an annular bottom is placed in the attachment hole.

Each of the two side walls 21 has another attachment hole formed at a position closer to its front than the attachment hole. A stopper 28 that contacts a sub arm extends through the attachment holes of the two side walls 21.

As shown in FIGS. 1 to 3B etc., the input arm 10 that swings when pushed by the cam 1 is an inner arm and is disposed between the two side walls 21 (in the space therebetween) of the output arm 20. The input arm 10 includes two side plates 11 and a connecting portion 12. The two side plates 11 extend next to each other at an interval in the lateral direction. The connecting portion 12 connects the lower parts of the distal end portions of the two side plates 11. Each of the two side plates 11 has a supported hole formed in its rear end portion so as to extend therethrough. The support pin 25 is inserted through the supported holes of the two side plates 11, so that the input arm 10 is swingably supported by the output arm 20. Both ends of the support pin 25 protrude from the two side walls 21 of the output arm 20, and retaining members 13 are fitted on these ends of the support pin 25 (the retaining members 13 are not shown in FIG. 1).

Each of the two side plates 11 has an attachment hole formed in its intermediate portion in the longitudinal direction of the side plate 11 so as to extend therethrough. A tubular roller shaft 14 is supported by the attachment holes of the two side plates 11, so that a roller 15 is rotatably supported by the roller shaft 14 via a bearing. The cam 1 contacts the upper part of the roller 15.

A switch device switches the connection state between the input arm 10 and the output arm 20 between a connected state (FIGS. 2B, 3A) where the input arm 10 is connected to the output arm 20 so that the input arm 10 is not allowed to swing relative to the output arm 20 and a disconnected state (FIGS. 2C, 3B) in which the input arm 10 is disconnected from the output arm 20. The switch device includes the first switch pin 16, the second switch pin 17, the third switch pin 18, a return spring 19, and the displacement device 30.

The first switch pin 16 is a tubular pin having an annular bottom. The first switch pin 16 is inserted in the first tubular member 26 and can be displaced between a connecting position (FIG. 3A) where the first switch pin 16 extends across an interface between an inner side of the first tubular member 26 and an inner side of the roller shaft 14 and a disconnecting position (FIG. 3B) where the first switch pin 16 does not extend across this interface.

The second switch pin 17 is a tubular pin. The second switch pin 17 is inserted in the roller shaft 14 and can be displaced between a connecting position (FIG. 3A) where the second switch pin 17 extends across an interface between the inner side of the roller shaft 14 and an inner side of the second tubular member 27 and a disconnecting position (FIG. 3B) where the second switch pin 17 does not extend across this interface.

The third switch pin 18 has a smaller diameter in its left portion than in its remaining portion. The third switch pin 18 is inserted in the second tubular member 27 such that the left portion of the third switch pin 18 can protrude leftward through a hole in the annular bottom of the second tubular member 27.

The return spring 19 is interposed between the annular bottom of the first tubular member 26 and the first switch pin 16 and biases the first switch pin 16 with its restoring force.

The two adjacent sets of input and output arms 10, 20 etc. are arranged symmetrically. Specifically, the first tubular members 26, the second tubular members 27, the first switch pins 16, the second switch pins 17, the third switch pins 18, and the return springs 19 of the two adjacent sets of input and output arms 10, 20 etc. are symmetrically arranged such that the third switch pins 18 face each other.

As shown in FIGS. 2A to 3B, the lost motion springs 29 are helical torsion springs. Coil portions of the lost motion springs 29 are placed around the retaining members 13, the rear portions of the lost motion springs 29 are engaged in the spring retaining recesses 24 of the output arm 20, and front portions of the lost motion springs 29 are in contact with the lower surfaces of the side plates 11 of the input arm 10 (the lost motion springs are not shown in FIG. 1). The lost motion springs 29 press the input arm 10 against the cam 1 with their biasing force when in the disconnected state.

As shown in FIGS. 1, 4 to 7C, etc., the displacement device 30 includes ring-shaped plates 31 and a support device 45.

A cylindrical plate shaft portion 4*a* with a larger outside diameter than the nose 3 of the cam 1 is provided between the cams 1 (cam lobes) of the camshaft 4. The plate shaft portion 4*a* is a part of the camshaft 4 and rotates with the camshaft 4.

The ring-shaped plates 31 are fitted on the plate shaft portion 4*a* so as to be co-rotatable with the plate shaft portion 4*a* and slidable in the longitudinal direction of the camshaft 4. A mechanism that makes the ring-shaped plates 31 co-rotatable with the camshaft 4 and slidable in the longitudinal direction of the camshaft 4 is formed by keys 32 placed in the plate shaft portion 4*a* and keyways 33 each formed in a part of the inner peripheral surface of a corresponding one of the ring-shaped plates 31.

One side surface of each ring-shaped plate 31 is a flat surface and can contact a corresponding one of the third switch pins 18. The other side surface of each ring-shaped plate 31 is divided into a tapered surface 34 and a flat surface 35 in the rotational direction. The tapered surface 34 is a surface formed so that the plate thickness increases toward the rotational direction, and the flat surface 35 is a surface formed so that the plate thickness does not change toward the rotational direction. A start portion of the tapered surface 34 is recessed like a step with respect to an end portion of the flat surface 35. An end portion of the tapered surface 34 smoothly connects to a start portion of the flat surface 35.

As described above, the displacement device 30 of the present embodiment simultaneously displaces the switch pins of the two adjacent sets of input and output arms 10, 20. The displacement device 30 includes the two ring-shaped plates 31 shaped symmetrically and disposed so that the two tapered surfaces 34 face each other and are synchronized with each other.

The displacement device 30 further includes two plate biasing mechanisms. Each plate biasing mechanism biases a corresponding one of the two ring-shaped plates 31 in a direction toward its other side surface. Each plate biasing mechanism is formed by a plate spring 36, balls 37, and a tilted surface 38. The plate shaft portion 4*a* has holes extending therethrough in a direction orthogonal to the direction in which the plate shaft portion 4*a* extends. The plate spring 36 of each plate biasing mechanism is placed in a corresponding one of the holes of the plate shaft portion 4*a*. The balls 37 are disposed at both ends of the plate spring 36. The tilted surface 38 is formed on the inner periphery of the ring-shaped plate 31 so that the balls 37 contact the tilted surface 38. A retaining protruding portion 39 is formed along an edge on one side of the tilted surface 38. As the balls 37 of the two plate biasing mechanisms push the tilted surfaces 38 with load of the plate springs 36, each of the two ring-shaped plates 31 is biased in a direction toward its other side surface and the flat surfaces 35 of the two ring-shaped plates 31 contact each other. The tapered surfaces 34 of the two ring-shaped plates 31 form a tapered groove 40 in which the distance between the tapered surfaces 34 changes from its inlet portion (between the start portions of the tapered surfaces 34) where the distance between the tapered surfaces 34 is slightly larger than the thickness of a support pin 46 to its end portion (between the end portions of the tapered surfaces 34) where the distance between the tapered surfaces 34 becomes equal to zero.

Figure 5:
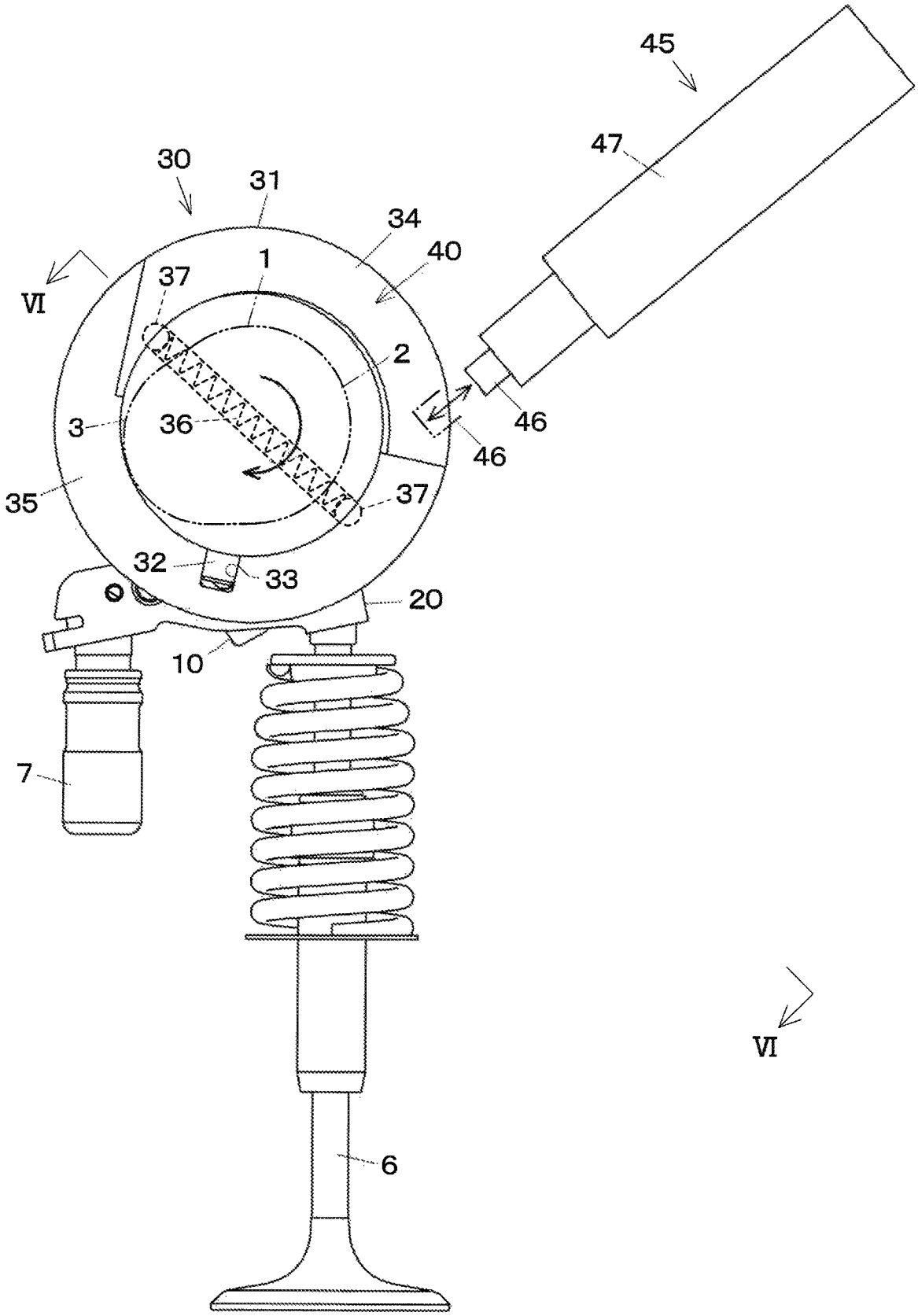
FIG. 5 is a sectional view taken along line V-V in FIG. 4.
Figure 6:
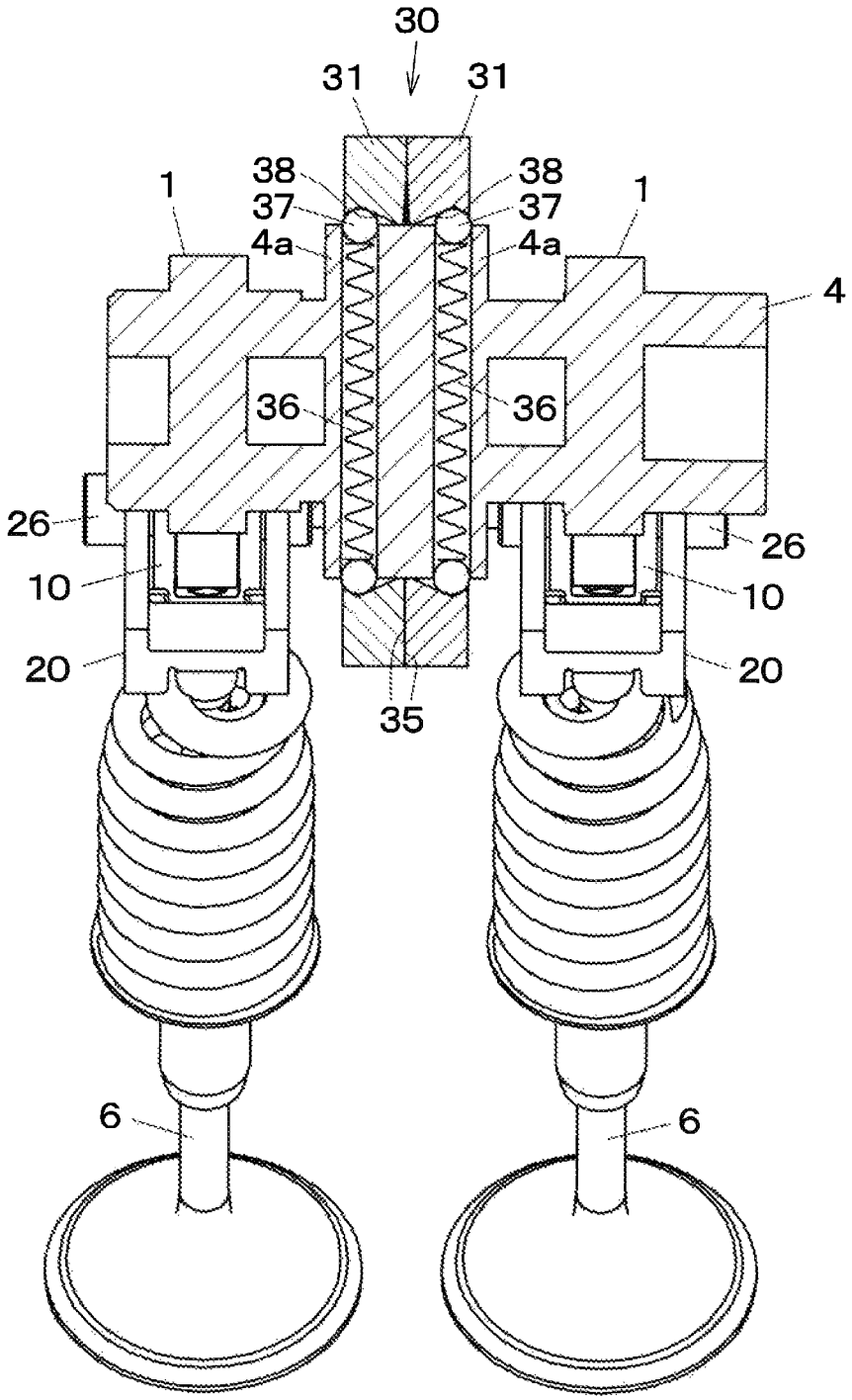
FIG. 6 is a sectional view taken along line VI-VI in FIG. 5.
Figure 7A:
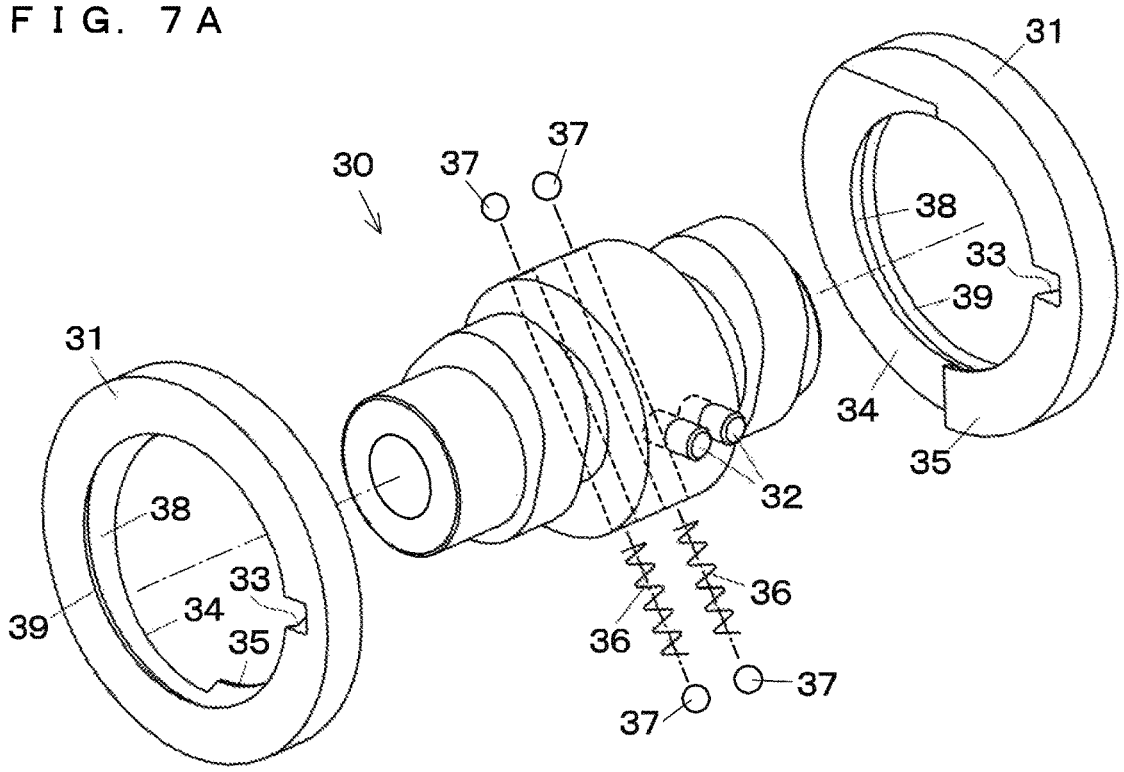
FIGS. 7A to 7C show a displacement device etc. of the variable valve mechanism, where
Figure 7B:
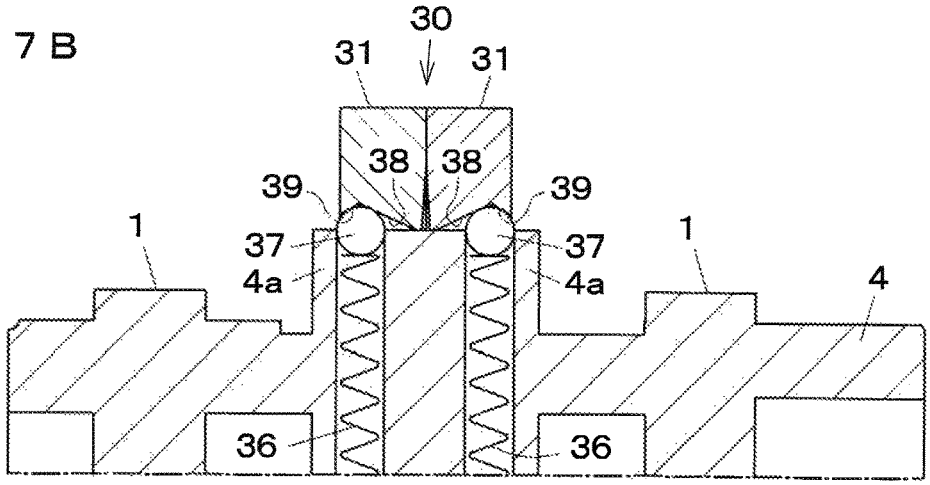
Figure 7C:
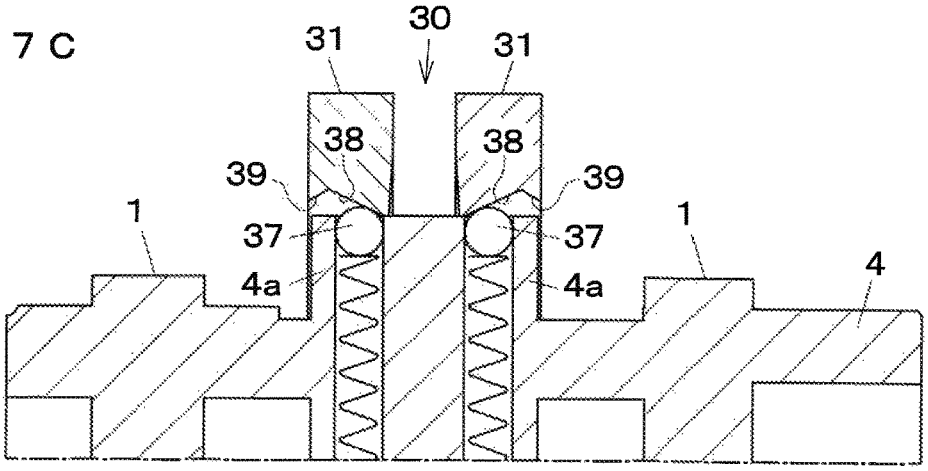
Figure 10:
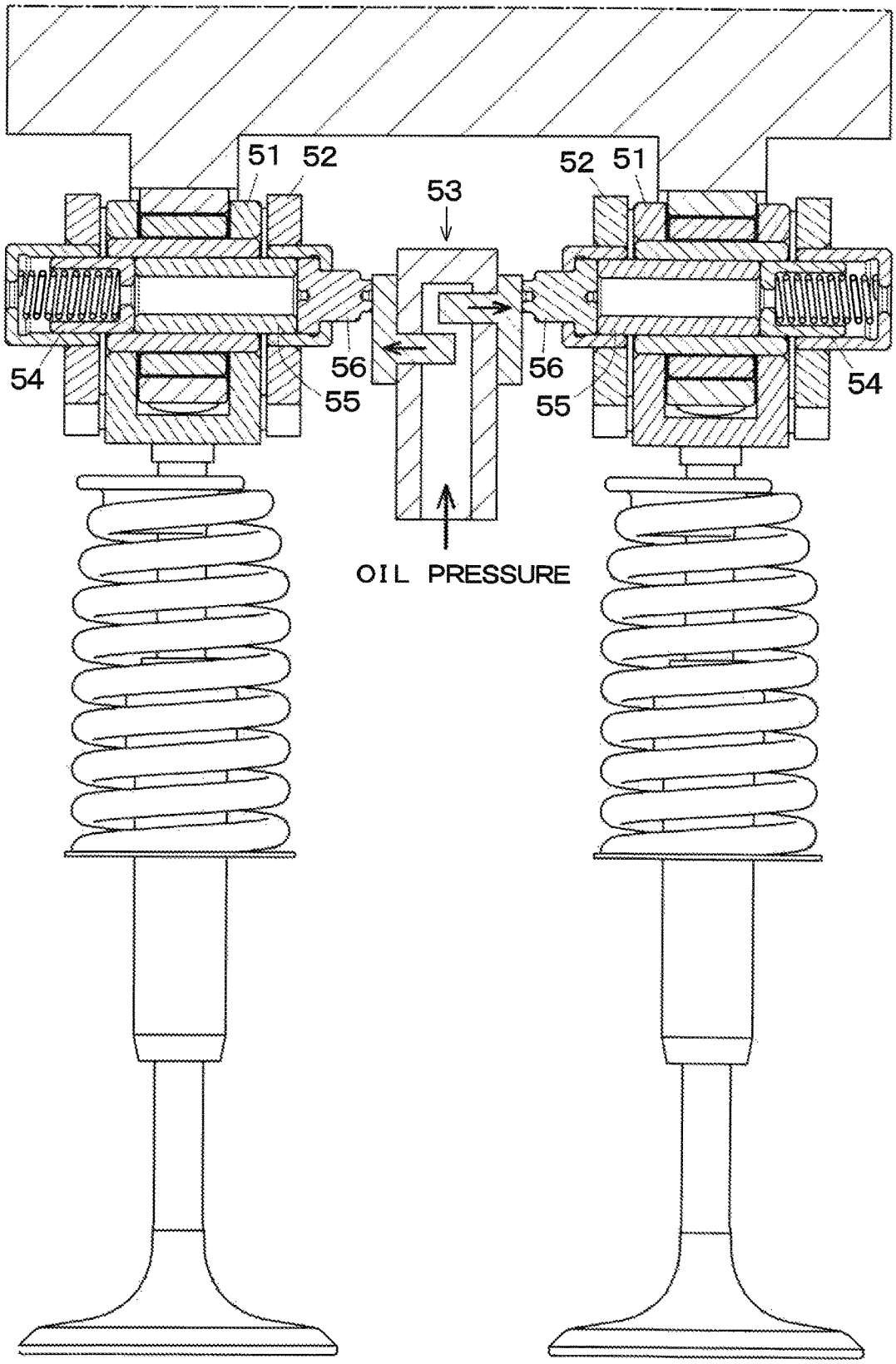
FIG. 10 PRIOR ART
FIG. 10 is a sectional view of a variable valve mechanism of a conventional example.

The support device 45 is formed by the support pin 46 and a moving device 47. The moving device 47 moves the support pin 46 to a position where the support pin 46 contacts the tapered surfaces 34 and a position where the support pin 46 does not contact the tapered surfaces 34. The support device 45 is disposed at a position that is not located between the two sets of arms (in this example, at a position located ahead and above the two sets of arms). The moving device 47 itself is fixed and does not move. Although the moving device 47 may be either an electromagnetically driven device (an electromagnetic solenoid etc.) or a hydraulically driven device, the moving device 47 is preferably an electromagnetically driven device. As shown in FIG. 5 etc., the support pin 46 is moved in a direction crossing the camshaft 4. Specifically, the support pin 46 is inserted from the outside into the inlet portion of the tapered groove 40 so that the support pin 46 is located at the position where the support pin 46 contacts the tapered surfaces 34. The support pin 46 is removed from the tapered groove 40 to the outside so that the support pin 46 is located at the position where the support pin 46 does not contact the tapered surfaces 34.

In the present embodiment, as shown in FIG. 5 etc., the position where the support pin 46 is inserted from the outside into the inlet portion of the tapered groove 40 is located ahead the central portions of the cams 1. Regarding the relationship of the angle of rotation between the cam 1 and the tapered groove 40, an intermediate portion of the base circle 2 corresponds to the inlet portion of the tapered groove 40, and an end portion of the base circle 2 in the nose 3 substantially corresponds to the end portion of the tapered groove 40.

Next, operation of the variable valve mechanism of the present embodiment configured as described above will be described.

1. Operation in Connected State (Valve Activation)

Figure 2A:
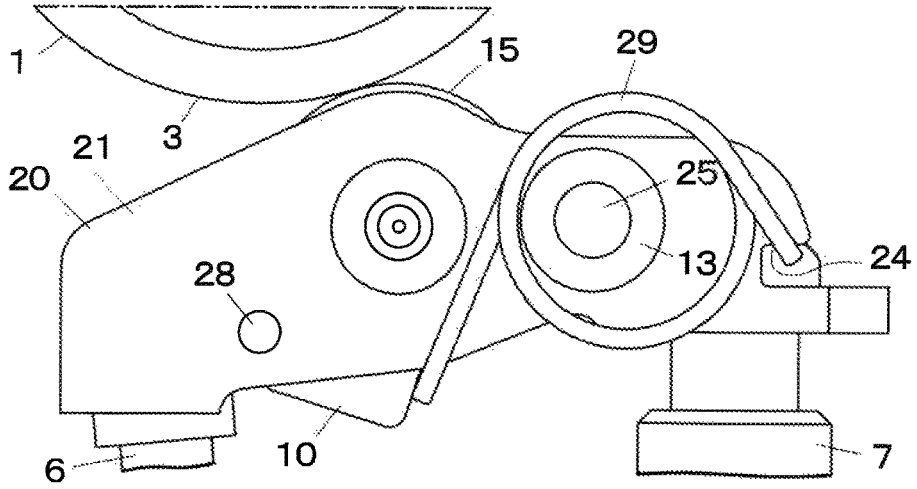
FIGS. 2A to 2C show an arm portion of the variable valve mechanism, where
Figure 2B:
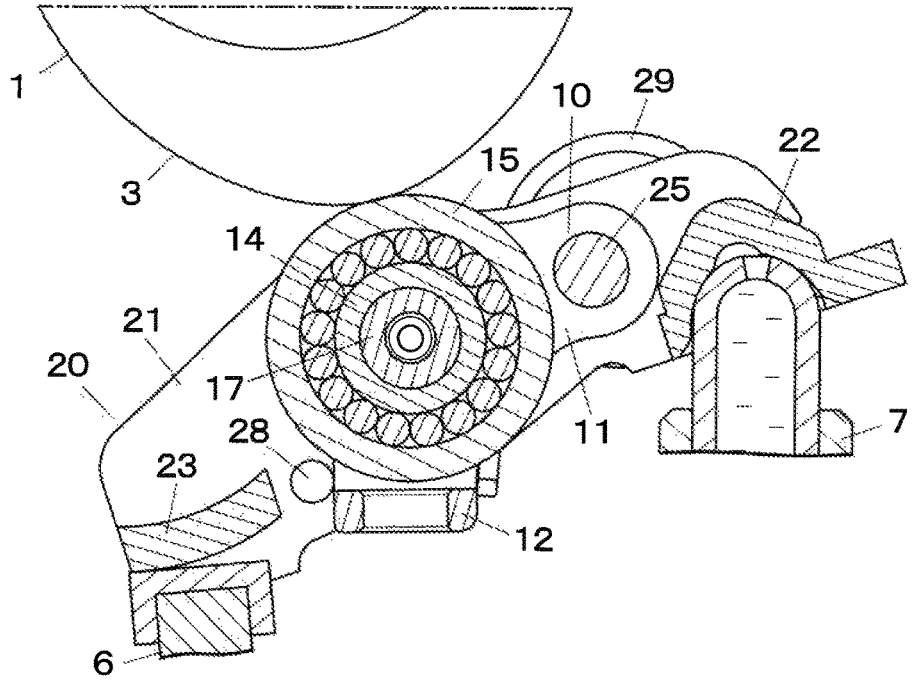
Figure 2C:
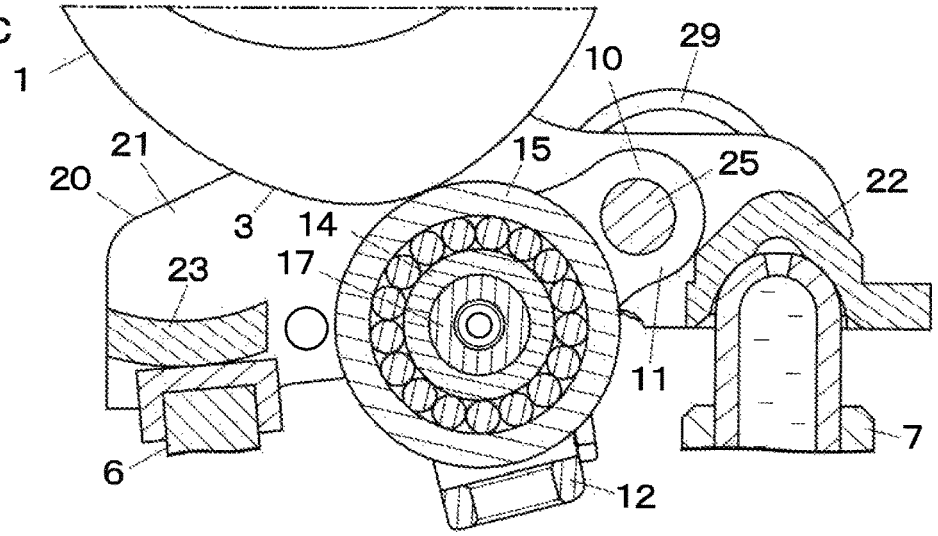
Figure 3A:
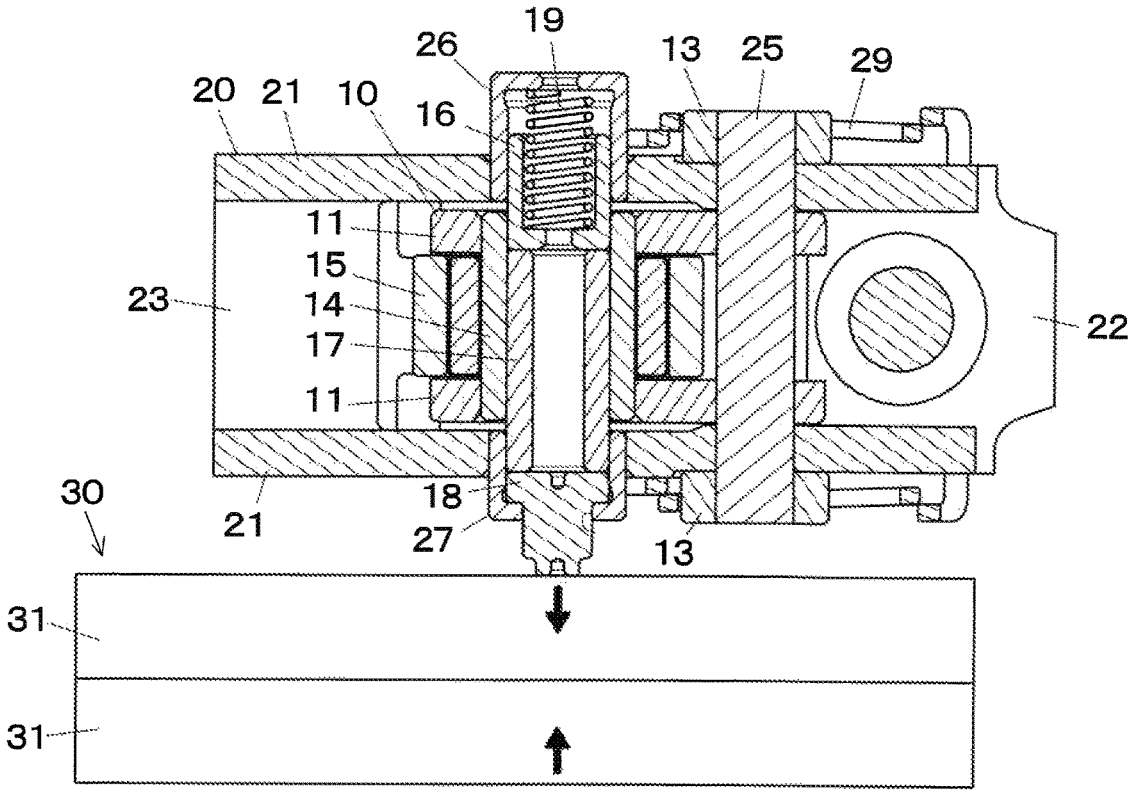
FIGS. 3A and 3B show the arm portion etc. of the variable valve mechanism, where

When the support pin 46 has been removed from the tapered groove 40 to the outside and is located at the position where the support pin 46 does not contact the tapered surfaces 34 as shown in FIG. 5, the ring-shaped plates 31 do not slide in the longitudinal direction of the camshaft 4 even when the ring-shaped plates 31 co-rotate with the camshaft 4. The third switch pins 18 slightly separated from the ring-shaped plates 31 are therefore not displaced. At this time, as shown in FIG. 3A, the first switch pins 16 and the second switch pins 17 are located in the connecting position due to the restoring force of the return springs 19. The input arms 10 are thus not allowed to swing relative to the output arms 20. The output arms 20 and the input arms 10 therefore swing downward together to activate the valves 6, as shown in FIG. 2B.

2. Operation when Switching from Connected State to Disconnected State (Valve Deactivation)

FIGS. 8A1 to 8B3 illustrate operation in a base circle phase (a phase during which the base circle 2 of the cam 1 contacts the roller 15).

As shown in FIGS. 8A1 and 8B1, in the beginning part of the base circle phase, the support pin 46 is inserted into the inlet portion of the tapered groove 40 so that the support pin 46 is located at the position where the support pin 46 contacts the tapered surfaces 34.

As shown in FIGS. 8A2 and 8B2, as the ring-shaped plates 31 rotate, the plate thickness at the position where the support pin 46 contacts the tapered surfaces 34 increases accordingly. Each ring-shaped plate 31 therefore starts to slide in the longitudinal direction of the camshaft 4 (that is, the ring-shaped plates 31 start to be separated from each other) against the load of the plate spring 36 (from FIG. 7B to FIG. 7C), so that one side surface of each ring-shaped plate 31 contacts the third switch pin 18.

Figure 3B:
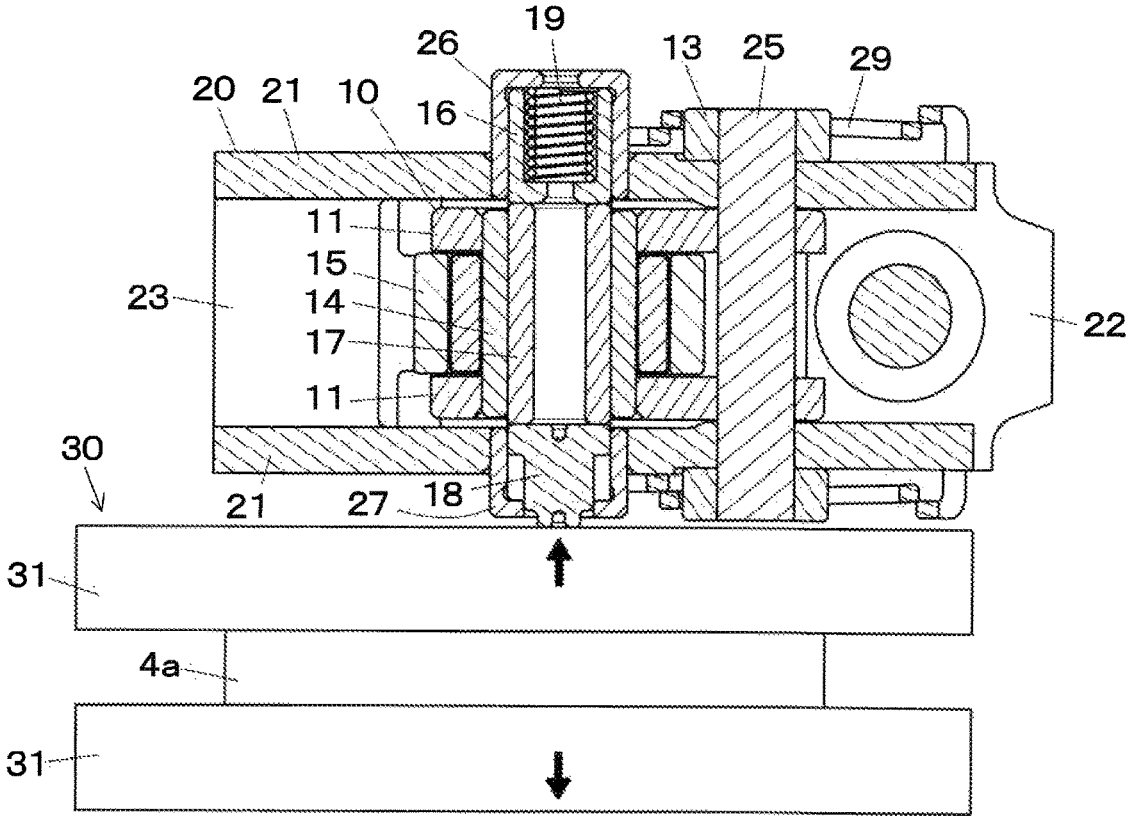
Figure 4:
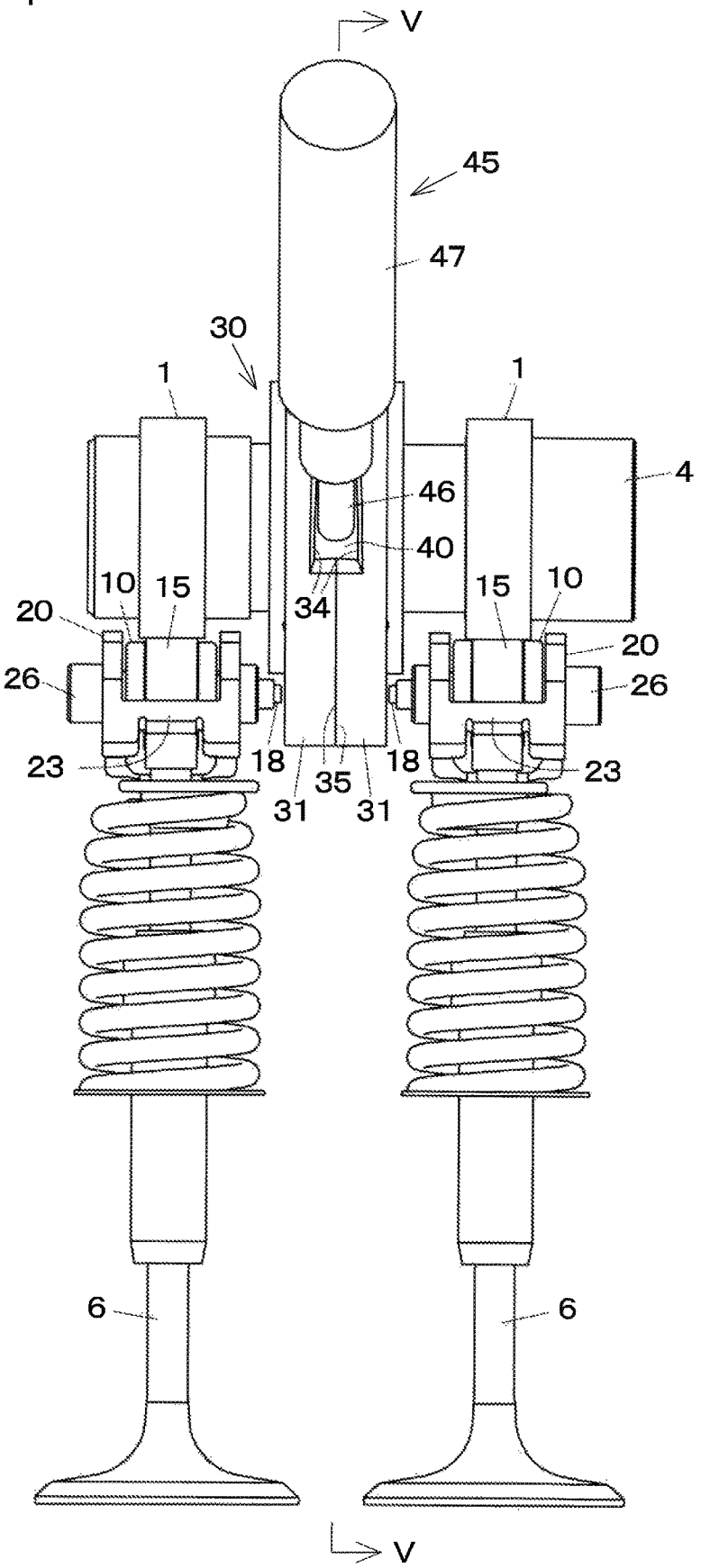
FIG. 4 is a front view of the variable valve mechanism.

As shown in FIGS. 8A3 and 8B3, when the end portion of the tapered groove 40 reaches the support pin 46 (after the end portion of the tapered groove 40 reaches the support pin 46, the flat surfaces 35 contact the support pin 46), the ring-shaped plates 31 finish being separated from each other and finish pushing the switch pins 16 to 18. As shown in FIG. 3B, the first and second switch pins 16, 17 are thus located at the disconnecting position and the input arms 10 are allowed to swing relative to the output arms 20.

FIGS. 9A1 to 9B3 illustrate operation in a nose phase (a phase during which the nose 3 of the cam 1 contacts the roller 15).

As shown in the FIGS. 9A1, 9B1 and 9A2, 9B2, even in the nose phase, the flat surfaces 35 are still in contact with the support pin 46 and the ring-shaped plates 31 are kept separated from each other. Since the disconnected state is maintained, only the input arms 10 are pushed by the noses 3 and swing about the support pin 25 (swings in an idle manner), and the output arms 20 do not swing downward. The valves 6 are thus deactivated.

As shown in FIGS. 9A3 and 9B3, by the time the end portions of the flat surfaces 35 contact the support pin 46 in the end part of the nose phase, the input arms 10 swung downward will have been substantially returned to their original positions due to the biasing force of the lost motion springs 29. In the beginning part of the subsequent base circle phase, the inlet portion of the tapered groove 40 contacts the support pin 46. The ring-shaped plates 31 are therefore moved toward each other by the load of the plate springs 36 (from FIG. 7C to FIG. 7B), resulting in the state shown in FIGS. 8A1 and 8B1.

As described above, the displacement device 30 displaces the switch pins 16 to 18 by using the co-rotation of the ring-shaped plates 31 mounted on the camshaft 4 with the camshaft 4 and the sliding of the ring-shaped plates 31, thereby connecting and disconnecting the input arms 10 to and from the output arms 20. Since the ring-shaped plates 31 of the displacement device 30 are mounted on the camshaft 4, no space is required between the arms in the cylinder head. The invention can thus solve the first problem described above. Since the ring-shaped plates 31 co-rotate with the camshaft 4 (that is, rotate synchronously with the cams 1) and the switch pins 16 to 18 can be displaced according to the cam timing, rebounding of the switch pins 16 to 18 can be reduced. The invention can thus solve the second problem described above.

The present invention is not limited to the above embodiment, and various modifications can be made as appropriate without departing from the sprit and scope of the invention.

REFERENCE SIGNS LIST

1 Cam
2 Base circle
3 Nose
4 Camshaft
4*a* Plate shaft portion
6 Valve
10 Input arm
16 First switch pin
17 Second switch pin
18 Third switch pin
20 Output arm
30 Displacement device
31 Ring-shaped plate
32 Key
33 Keyway
34 Tapered surface
35 Flat surface
36 Plate spring
37 Ball
38 Tilted surface
39 Retaining protruding portion
40 Tapered groove
45 Support device
46 Support pin
47 Moving device

The invention claimed is:

1. A variable valve mechanism of an internal combustion engine, the variable valve mechanism comprising:

a first member and a second member which are disposed between a cam and a valve;

a switch pin that is displaced so as to connect and disconnect the first member to and from the second member; and a displacement device that is disposed outside the first member and the second member and displaces the switch pin, wherein the displacement device includes:

a ring-shaped plate that is fitted on a camshaft of the cam so as to rotate with the camshaft and configured to slide in a longitudinal direction of the camshaft, the ring-shaped plate including a first surface configured to contact the switch pin and a second surface including a tapered surface formed such that a plate thickness of the ring-shaped plate increases in a rotational direction of the ring-shaped plate, and a support device formed by a support pin and a moving device that selectively moves the support pin between a position where the support pin contacts the tapered surface and a position where the support pin does not contact the tapered surface.

2. The variable valve mechanism according to claim 1, wherein a key or a keyway makes the ring-shaped plate rotate with the camshaft and configured to slide in the longitudinal direction of the camshaft.

3. The variable valve mechanism according to claim 1, further comprising:

a plate biasing mechanism that biases the ring-shaped plate in a direction that the second surface of the ring-shaped plate faces.

4. The variable valve mechanism according to claim 3, wherein the plate biasing mechanism is formed by a plate spring placed in a hole extending through the camshaft in a direction orthogonal to the camshaft, balls disposed at ends of the plate spring, and a tilted surface formed on an inner periphery of the ring-shaped plate such that the balls contact the tilted surface.

5. The variable valve mechanism according to claim 1, wherein the first member comprises an input member that is displaced when pushed by the cam, and the second member is an output member that is displaced so as to push the valve.

6. The variable valve mechanism according to claim 5, wherein the output member includes a swingable arm.

7. The variable valve mechanism according to claim 6, wherein the input member includes a swingable arm.

8. A variable valve mechanism of an internal combustion engine, the variable valve mechanism comprising:

a first member configured as an input arm and a second member configured as an output arm which are disposed between a cam and a valve;

a third member configured as a second input arm and a fourth member configured as a second output arm which are disposed between a second cam and a second valve;

a switch pin that is displaced so as to connect and disconnect the first member to and from the second member;

a second switch pin that is displaced so as to connect and disconnect the third member to and from the fourth member; and a displacement device that is disposed outside the first, the second, the third, and the fourth members, and simultaneously displaces the switch pin and the second switch pin, wherein the displacement device includes:

a second ring-shaped plate that is fitted on the camshaft of the cam and the second so as to rotate with the camshaft and configured to slide in the longitudinal direction of the camshaft, the ring-shaped plate including a first surface configured to contact the switch pin and a second surface including a tapered surface formed such that a plate thickness of the ring-shaped plate increases in a rotational direction of the ring-shaped plate;

a second ring-shaped plate that is fitted on a camshaft of the cam and the second cam so as to rotate with the camshaft and configured to slide in a longitudinal direction of the camshaft, the second ring-shaped plate including a first surface configured to contact the second switch pin and a second surface including a tapered surface formed such that a plate thickness of the second ring-shaped plate increases in a rotational direction of the second ring-shaped plate, wherein the tapered surface of the ring-shaped plate and the tapered surface of the second ring-shaped plate face each other; and a support device formed by a support pin and a moving device that selectively moves the support pin between a position where the support pin contacts the tapered surface of the ring-shaped plate and the tapered surface of the second ring-shaped plate, and a position where the support pin does not contact the tapered surface of the ring-shaped plate and the tapered surface of the second ring-shaped plate, and wherein the support pin is inserted from outside of a tapered groove formed by the tapered surface of the ring-shaped plate and the tapered surface of the second ring-shaped plate, into the tapered groove such that the support pin is located at the position where the support pin contacts the tapered surfaces of the ring-shaped plate and second ring-shaped plate, and the support pin is removed from the tapered groove to the outside such that the support pin is located at the position where the support pin does not contact the tapered surface of the ring-shaped plate and the tapered surface of the second ring-shaped plate.

9. The variable valve mechanism according to claim 8, wherein a key and a keyway makes the ring-shaped plate rotate with the camshaft and configured to slide in the longitudinal direction of the camshaft.

10. The variable valve mechanism according to claim 8, further comprising:

a plate biasing mechanism that biases the ring-shaped plate in a direction that the second surface of the ring-shaped plate faces.

11. The variable valve mechanism according to claim 10, wherein the plate biasing mechanism is formed by a plate spring placed in a hole extending through the camshaft in a direction orthogonal to the camshaft, balls disposed at ends of the plate spring, and a tilted surface formed on an inner periphery of the ring-shaped plate such that the balls contact the tilted surface.

12. The variable valve mechanism according to claim 8, wherein the input arm is displaced when pushed by the cam, and the output arm is displaced so as to push the valve.

13. The variable valve mechanism according to claim 12, wherein the output arm includes a swingable arm.

14. The variable valve mechanism according to claim 13, wherein the input arm includes a swingable arm.

* * * * *